United States Patent [19]

Kataoka

[11] Patent Number: 4,697,755

[45] Date of Patent: Oct. 6, 1987

[54] REWINDER WITH SLITTER

[76] Inventor: Hiroshi Kataoka, 3686, Sangawacho, Iyomishima-shi, Ehime 799-04, Japan

[21] Appl. No.: 769,733

[22] Filed: Aug. 27, 1985

[30] Foreign Application Priority Data

Aug. 27, 1984 [JP] Japan ..... 59-176567
Dec. 27, 1984 [JP] Japan ..... 59-273794

[51] Int. Cl.[4] ..... B65H 18/10; B65H 18/16; B65H 35/02

[52] U.S. Cl. ..... 242/56.4; 242/75.1

[58] Field of Search ..... 242/56.4, 56.5, 56.2, 242/67.1 R, 75.1, 75.2, 75.51, 65

[56] References Cited

U.S. PATENT DOCUMENTS

| | | | |
|---|---|---|---|
| 3,086,726 | 4/1963 | Aaron | 242/56.5 X |
| 3,279,718 | 10/1966 | Arterton et al. | 242/65 X |
| 3,687,388 | 8/1972 | Pfeiffer | 242/75.51 X |
| 3,712,554 | 1/1973 | Lorenzini et al. | 242/56.2 |
| 3,734,423 | 5/1973 | Kataoka | 242/56 A |
| 3,784,122 | 1/1974 | Kataoka | 242/56 A |
| 4,150,797 | 4/1979 | Kataoka | 242/67.1 R |
| 4,171,780 | 10/1979 | Bugnone | 242/56.2 X |
| 4,238,084 | 12/1980 | Kataoka | 242/75.51 |
| 4,374,575 | 2/1983 | Lerch et al. | 242/56.5 |
| 4,431,142 | 2/1984 | Kataoka | 242/68.1 |
| 4,508,284 | 4/1985 | Kataoka | 242/75.51 |
| 4,601,435 | 7/1986 | Tomma et al. | 242/56.4 |
| 4,609,162 | 9/1986 | Kataoka | 242/56 R |
| 4,634,069 | 1/1987 | Kataoka | 242/65 |

FOREIGN PATENT DOCUMENTS

| | | |
|---|---|---|
| 59-13414 | 3/1984 | Japan . |
| 61-37648 | 2/1986 | Japan . |
| 61-203050 | 9/1986 | Japan . |

*Primary Examiner*—John M. Jillions
*Attorney, Agent, or Firm*—Oblon, Fisher, Spivak, McClelland, & Maier

[57] ABSTRACT

A strip-like sheet is slit into a plurality of slit sheets by means of cutters. The slit sheets are distributed to a plurality of winding positions and wound on a winding axle to form a sheet roll thereof on the winding axle. A touch roller provided with a driving mechanism is provided in each of the sheet rolls to make it possible for the slit sheet to be wound while the supply tension thereof is adjusted immediately before the winding.

9 Claims, 27 Drawing Figures

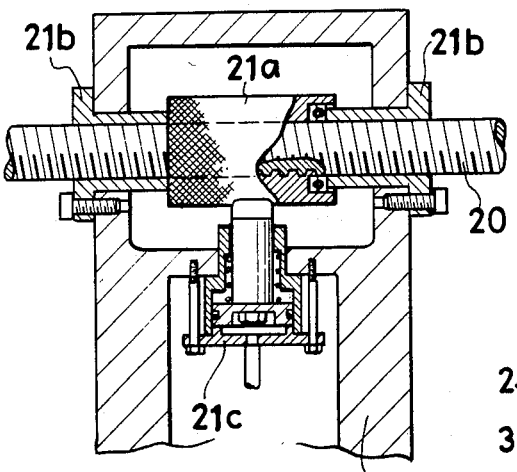
FIG. 8
FIG. 10
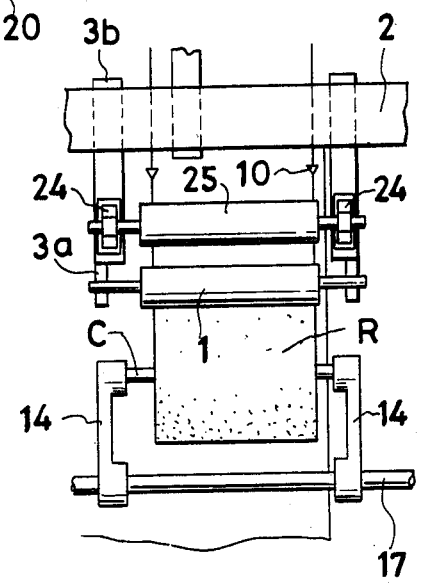
FIG. 14
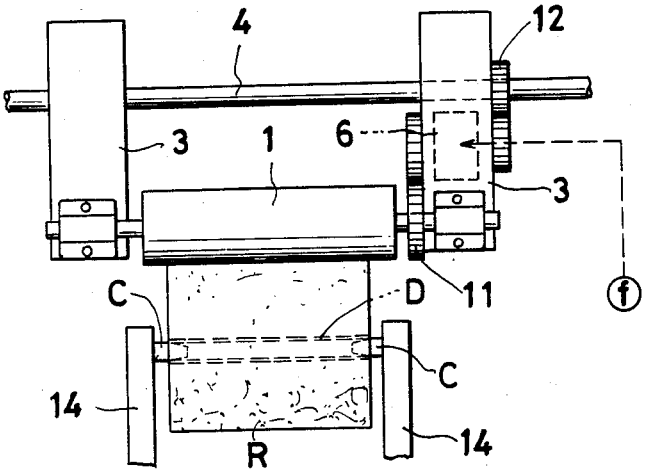

REWINDER WITH SLITTER

BACKGROUND OF THE INVENTION

1. Field of the Invention

The present invention relates to a rewinder with slitter for slitting a strip-like sheet of plastic film, paper or the like into a plurality of slit sheets to be wound on winding axles or winding cores which are mounted on the winding axles in an inserting manner.

2. Description of Prior Art

For good quality winding of the strip-like sheet on the winding axle into a roll shape by rotatably driving the winding axle, torque of the winding axle for adjusting winding tension of the strip-like sheet and contact pressure of a touch roller brought into contact with the roll of the strip-like sheet for adjusting the amount of air involved between sheet layers of the sheet roll in the winding operation on the winding axle are both important factors to be controlled. However, it is not necessarily possible to obtain a high quality wound sheet roll even if both the torque of the winding axle and the contact pressure between the sheet roll and the touch roller are precisely controlled.

The reason is that, for example, when the strip-like sheet taken off the roll of material by means of unwinding rollers (hereinafter referred to as "the take-our operation") is fed to its winding section to be wound on the winding axles, since the strip-like sheet to be fed to the winding section is already stretched within its elastic limit under the effect of the tension produced therein in the take-out operation, and the stretching of the strip-like sheet generally varies with every change of tension in the take-out operation due to deformation and the like of the material roll thereof, the stretching of the strip-like sheet produced immediately before its winding operation, i.e., residual stress, affects its winding tension.

For example, the stretching of the strip-like sheet already produced immediately before the winding operation is added to stretching produced under the effect of the tension of the strip-like sheet caused by the torque of the winding axle, and, as a result of this, the strip-like sheet is wound under excessive stretching. Consequently, inner layers of the sheet roll are compressed by the outer layers thereof under the effect of the contacting force of the strip-like sheet, producing a permanent set such as a lateral rumple therein so that the strip-like sheet is taken out or unwound in poor condition.

Therefore, in order to obtain a high quality wound sheet roll, it is essential to control the tension of the strip-like sheet immediately before it is wound on the winding axle, and to control the torque of the winding axle and the contact pressure between the touch roller and the sheet roll.

It has been proposed, for example in Japanese Patent Publication No. SHO 59(1984)-13414, that, because of the necessity of controlling the tension of the strip-like sheet immediately before it is wound, a rewinder with slitter controls the tension of a slit sheet S' immediately before it is wound by the powered rotation of a touch roller through a transmission mechanism for fine adjustment of its transmitting speed so as to be able to control the circumferential speed of the touch roller relative to the circumferential speed of the unwinding roller which unwinds a wide width of strip-like sheet from the material roll thereof, the touch roller being brought into contact with a plurality of the sheet rolls R for winding individual slit sheets.

On the other hand, there is a tendency to gradually vary the kind of the strip-like sheet to be slit and wound by means of the rewinder with slitter. For example, there is a tendency nowadays to progressively thin down a plastic film, and as a result a very thin one having a thickness of several tens of microns or of only a few microns is produced. In addition to this, many kinds of strip-like sheets are produced nowadays, some being easily stretchable even under low tension, others having a smooth surface such as a mirror finish and therefore having a low friction coefficient so that it easily slips etc.

Thin, easily stretched strip-like sheet is apt to rumple while the strip-like sheet which easily slips tends in the winding operation to suffer slippage of intermediate sheet layers axially to the sheet roll so that unevenness is produced on the ends of the roll though the upper layers of the sheet roll contacting the touch roller and the winding core of the sheet roll are held stationary.

Further, strip-like sheet varies in thickness. For example, plastic film of a thickness of 20 microns has a dimensional tolerance of thickness in the range of $\pm 1$ micron, or more in some cases. Nowadays, there is strongly felt need to wind strip-like sheet at high speed and with high quality.

On the other hand, regardless of the mechanical precision of the winder, some factors causing the wrinkling which deteriorates the winding quality of the sheet roll still exist in slitting and winding of the strip-like sheet. Such factors include: a concentration of tension in thicker portions of strip-like sheet of irregular thickness across its width during the movement thereof; concentration of tension in an area of the strip-like sheet leading to a larger diameter portion of the sheet roll, and as the larger diameter portion has a higher circumferential speed than the smaller diameter portion, the larger diameter portion pulls the strip-like sheet faster in such an area than in other areas, so the sheet roll varies slightly in its outer diameter along its axis, due to the superposition of sheets of irregular thickness as the sheets pile up on the roll; also, there is irregularity in tension distribution caused by deformation of the sheet roll in the initial stages of the winding operation due to flexing of the winding core of the sheet roll; and the like. Especially, wrinkling of the strip-like sheet in the direction of the sheet travel, or oblique wrinkling produced across the direction of travel of the strip-like sheet immediately before it is wound, is involved in the sheet roll, and as it folds and piles up, the outer diameter of the sheet roll increases over the wrinkling, causing build-up of contact pressure and tension, producing permanent strain in such portions, frequently deteriorating or ruining the value of the strip-like sheet as merchandise.

However, since it is substantially impossible to eliminate the factors causing the wrinkling, it is necessary to prevent wrinkling being produced even when such factors exist. From this necessity, various studies have been carried out. As a result, it has been found that the smaller the outer diameter of the touch roller, thus the smaller the radius of curvature of the strip-like sheet around the touch roller, the more difficult it is to deform the strip-like sheet axially to the touch roller, thus making it hard to produce wrinkles in the sheet wound on the winding axle.

However in the touch roller of the above-mentioned rewinder with slitter, since any of the contacting pressure loads of a plurality of the sheet rolls is applied to the touch roller and the span between the ends of the touch roller is considerable, it is not possible to reduce the outer diameter of the touch roller as this would affect its structural strength. For example, in a rewinder with slitter in which a width of the strip-like sheet unwinding from the roll is 6 m, the supporting span between the ends of the touch roller is approximately 7 m while its outer diameter is approximately 0.6 m.

Further, for preventing the wrinkling, it is necessary that the strip-like sheet which has been slit travels at a constant speed over its full width. However, it is not possible to precisely hold any portion of the slit sheet by means of the touch roller so that it travels at such a constant speed, because the adhesive force of the strip-like sheet to an outer peripheral surface of the touch roller is still smaller than in the case where a small diameter touch roller is employed, even when the same tension as that applied to the strip-like sheet contact with the small diameter touch roller is applied to the strip-like sheet running around the touch roller since the touch roller has a large outer diameter, as described above, and also because it is not possible to obtain sufficient frictional force between the slit strip-like sheet and the touch roller since air is apt to be entrained between the outer peripheral surface of the sheet roll and the strip-like sheet with the speed-up in the winding operation of the strip-like sheet, so that the frictional coefficient therebetween decreases.

Consequently, in a conventional rewinder with slitter provided with the touch roller, it is not possible to slit and wind the sheet and prevent wrinkling.

Further, in the case of strip-like sheet having a slipping surface, in order to prevent irregularities from being produced at the ends of the sheet roll, it is necessary to prevent air from being entrained between sheet layers, thereby preventing decrease of the frictional cofficient therebetween, and increasing the contacting pressure therebetween.

Since the outer diameter of the touch roller is large so that the contact area of the touch roller with respect to the sheet roll is large, to reduce the contact pressure per unit area therebetween, it is necessary to provide a large urging force between the touch roller and the sheet roll in order to increase the contact pressure therebetween. Further, when the winding operation is speeded up, the amount of air involved in the sheet roll is increased, making it necessary to further increase such urging force. However, when such urging force is further increased between the touch roller and the sheet roll, the sheet roll is deformed, increasing its resistance in rotation, and torque loss of the winding axle is increased, making control of the tension of the sheet in the winding operation unstable and often producing irregularity in the ends of the sheet roll thus wound.

Consequently, in some cases, it is not possible to obtain a sufficient contact pressure with such slippery strip-like sheet by means of the touch roller.

In such circumstances, the rewinder with slitter provided with the conventional touch roller does not necessarily meet the user"s level of requirements, because the thinner the strip-like sheet becomes the easier it stretches, and the more slippery its surface becomes the less the yield of quality-wound sheet roll.

OBJECT OF THE INVENTION

In consideration of the above, it is an object of the present invention to provide a rewinder with slitter which enables any kind of the strip-like sheet, for example, thin sheet and slippery sheet, to be wound on each winding axle at high speed and in good condition after it is slit into a prescribed width, while preventing production of wrinkling therein even when its unwinding condition from the roll changes or the sheet is of irregular thickness.

SUMMARY OF THE INVENTION

For accomplishing the above object, in the rewinder with slitter according to the present invention there is provided each touch roller, which is provided with a driving means having a transmission means for finely adjusting its rotational speed, with respect to each winding axle for winding the slit sheet.

As described above, since a powered touch roller is provided in each winding axle to make it possible to reduce a diameter of each touch roller, so that the resistance of the strip-like sheet against deformation in the axial direction of the sheet roll is increased while the adhesive force between the strip-like sheet and the touch roller is increased to increase the frictional force therebetween. As a result, it is possible for the strip-like sheet to travel at a constant speed across its full width and the circumferential speed of the touch roller relative to that of the unwinding roller can be changed, making it possible to adjust the tension of the strip-like sheet immediately before it is wound. Consequently, it is possible to prevent in the strip-like sheet or the sheet roll the wrinkling which hitherto was produced immediately before winding or in the wound roll; it is also possible to reduce the contact area between the sheet roll and the touch roller, increasing the contact pressure per unit area even when the urging force acting therebetween is small so that air is prevented from being involved in the sheet roll while the resistance of the sheet roll in its rotation is decreased so that the torque loss of the winding axle is reduced. Further, since it is possible to adjust the tension of the strip-like sheet immediately before it is wound by means of the transmission means for finely adjusting the rotational speed of the touch roller, it is possible to immediately control both the tension of the strip-like sheet to be wound and the torque of the winding axle so that the tension of the thus wound strip-like sheet is held at an appropriate level.

As described above, according to the present invention, it is possible to wind strip-like sheet, for example thin and easily stretched sheet or sheet having a slippery surface, at high speed and with high quality of winding by provision of touch rollers which are individually provided for each strip across the width of the strip-like sheet and individually supported so that their rotational speeds relative to the circumferential speed of the unwinding rollers can be finely adjusted.

BRIEF DESCRIPTION OF THE DRAWINGS

Other objects and features of the present invention will be clarified through the following description with reference to the accompanying drawings, in which:

FIG. 8 is a sectional view of the engaging/disengaging device for the supporting arm of the winder shown in FIG. 5;

FIG. 10 is a plan view of the principal parts of the winder shown in FIG. 9;

FIG. 14 is a plan view of a modification of the winder shown in FIG. 9;

DESCRIPTION OF THE PREFERRED EMBODIMENTS

Figure 1:
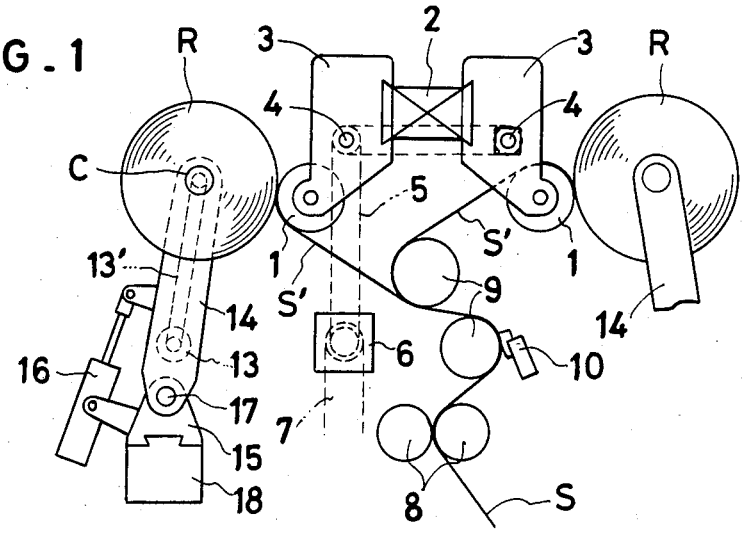
FIG. 1 is an outline of a side view of a first embodiment of the rewinder with slitter of the present invention.
Figure 2:
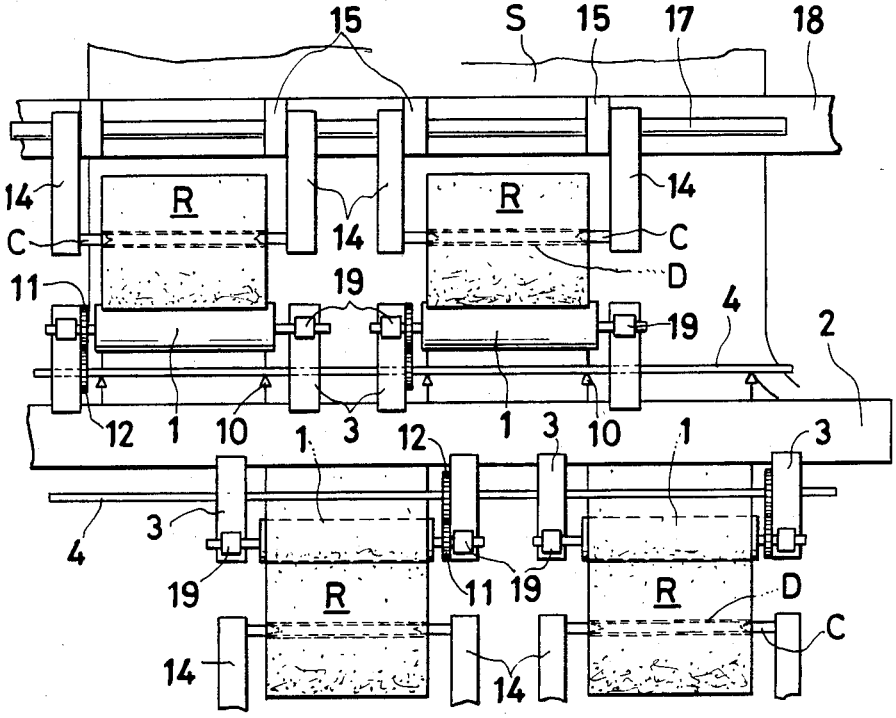
FIG. 2 is a plan view of the winder shown in FIG. 1.
Figure 3:
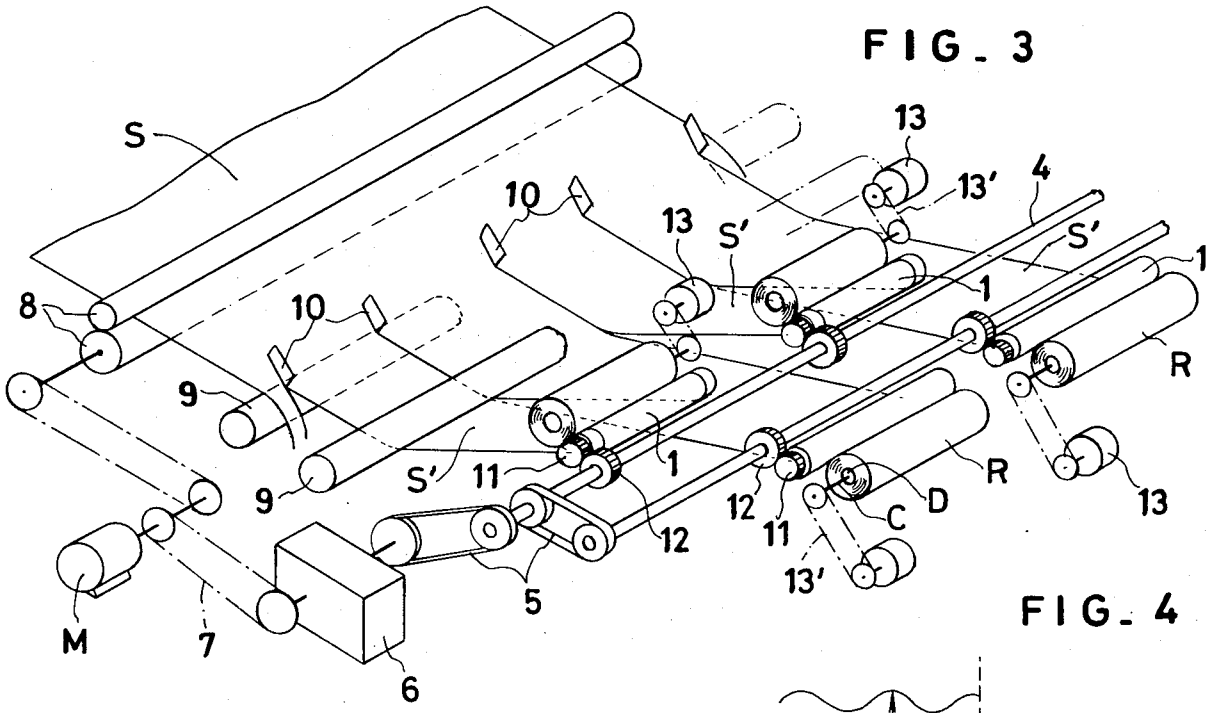
FIG. 3 is a perspective view of the winder shown in FIG. 1, showing the driving mechanism of the rewinder with slitter.

In FIGS. 1 to 3, there is shown a first embodiment of the rewinder with slitter of the present invention, wherein the reference numeral 2 designates a beam-like base mount which is provided in an upper central portion of the rewinder with slitter and the length of which is greater than the width of a strip-like sheet S. A plurality of supporting frames 3 each of which is provided with a touch roller supporting means 19 at its front end are slidably mounted on both sides of the base mount 2 so that they are arranged in a back-to-back relationship and slidably guided and supported by the base mount 2, each pair of supporting frames 3 arranged side by side supporting a touch roller 1 rotatably at their ends. The supporting means 19 for the touch roller 1 in the supporting frame 3 is constructed according to the following manner: For example, bearing units are provided at both ends of the touch roller 1 so that they are fixed to the supporting frames 3 by means of bolts; or chucking means are provided that are movable in the axial direction of the touch roller 1 so that the touch roller 1 is fixed to the supporting frames 3 through such chucking means; or the journal portions in the end portions of the touch roller 1 are clamped through suitable clamping mechanisms. Along both of the right and left sides (in FIG. 1) of the base mount 2, there are provided touch roller driving axles 4 which pass through the supporting frames 3 and which are driven by a rotation transmission mechanism 6 provided at the end thereof which is driven by a driving source M through a transmission mechanism 7 and a finely adjustable speed change mechanism 6. On an end of the axles 4 which support the touch rollers 1 is mounted a gear 11, while on the driving axle 4 is mounted another gear 12 which meshes with the gear 11 so that each of the touch rollers 1 is simultaneously driven by the rotation of the driving axle 4.

As the above finely adjustable speed change mechanism 6, it is possible to employ a suitable speed change mechanism, such as for example a speed change mechanism consisting of a pair of cone-shaped pulleys and an endless belt running around these pulleys; or a speed change mechanism utilizing the speed change ability of a powder clutch which enables the torque to be remote-controlled; or a speed change mechanism such as a continuous differential adjusting unit consisting of a combination of a speed reduction mechanism and a differential mechanism, the speed reduction mechanism being the type called a harmonic drive which produces a very wide speed reduction ratio between an input shaft and an output shaft thereof; or other stepless speed change mechanism; or a speed change mechanism which in combination with the gears performs a speed changing operation. Although in the embodiment shown in the drawings all the touch rollers 1 on both sides of the base mount 2 are rotated by means of the finely adjustable speed change mechanism 6 while being finely adjusted in their rotational speeds thereby, it is possible to provide such speed change mechanism 6 on each of the driving axles 4 so that the touch rollers 1 are finely adjusted in their rotational speeds at each side of the base mount 2, or it is possible to provide such speed change mechanism 6 in the drive trains between each driving axle 4 and touch roller 1 so that each touch roller 1 is individually finely adjusted in its rotational speed.

A winding core D is mounted on a winding axle C supported at the ends of a pair of winding arms 14 so that the winding core D is opposed to each touch roller 1, while each winding arm 14 is swingably mounted on a supporting shaft 17 provided in a supporting base 15 which is slidably supported on a base mount 18 provided in the width direction of the strip-like sheet S. Between the supporting base 15 and the winding arm 14 is provided a hydraulic cylinder 16 the driving force of which is controlled to adjust the contact pressure between the surfaces of a sheet roll R and the touch roller 1. The widing axle C is rotated at a prescribed speed by a driving mechanism the driving force of which is transmitted to the winding axle C through a belt 13'. As a driving mechanism 13, it is possible to employ a DC motor, a hydraulic motor or a combination mechanism comprised of a separately-provided motor and a powder clutch provided in the winding arm 14.

The reference numeral 10 designates a slitter blade for slitting the strip-like sheet S from unwinding rollers 8 into a plurality of strip-like sheets S or slit sheets each of which has a prescribed width.

In the rewinder with slitter having the above-described construction, the slitter blade 10 is positioned in a prescribed position according to the width of the sheet to be slit, while the touch rollers supporting frames 3 and the winding arms 14 are moved on the base mounts 2 and 18 respectively so that they are positioned in prescribed positions according to the width of the sheet to be slit, and both the touch rollers 1 having a prescribed length and the winding cores D are supported by the supporting frames 3 and the winding arms 14, respectively.

According to the present invention, since the touch rollers 1 are forcibly rotated and are provided for each of the sheet rolls R, it is possible to reduce the outer diameter of the touch rollers 1 compared to that of the touch rollers of the conventional rewinder with slitter, and it is possible to adjust the tension of the slit sheet S' being fed to the winding axle C between the touch roller 1 and the unwinding rollers 8. In the case of the width of the sheet to be slit being small, it is possible to bring the touch rollers 1 into contact with a plurality of the sheet rolls R. In general, since according to the present invention touch rollers 1 are provided for each of the sheet rolls R, a single touch roller is not subjected to a large bending force in contrast with the case of the touch roller employed in the conventional rewinder with slitter, in which a large bending force is applied by a large number of the sheet rolls R to the touch rollers 1. Furthermore, since the length of the touch rollers 1 is shortened, there is no fear that the touch rollers 1 will lack structural strength, even when the outer diameter of the touch rollers 1 is reduced as described above. The more the outer diameter of the touch rollers 1 is reduced, the more effectively it prevents air from being involved between the sheets of the sheet roll R, while the weight of the touch rollers 1 is reduced, enabling them to be easily handled. As described above, according to the present invention, it is possible to reduce the diameter of the touch rollers 1, and it is preferable to reduce the diameter of the touch rollers 1 to the extent that the touch roller 1 does not lack structural strength in use.

Figure 4:
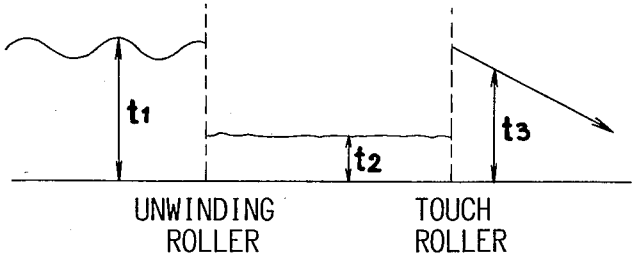
FIG. 4 is a diagram illustrating the state of tension of the sheet.
Figure 5:
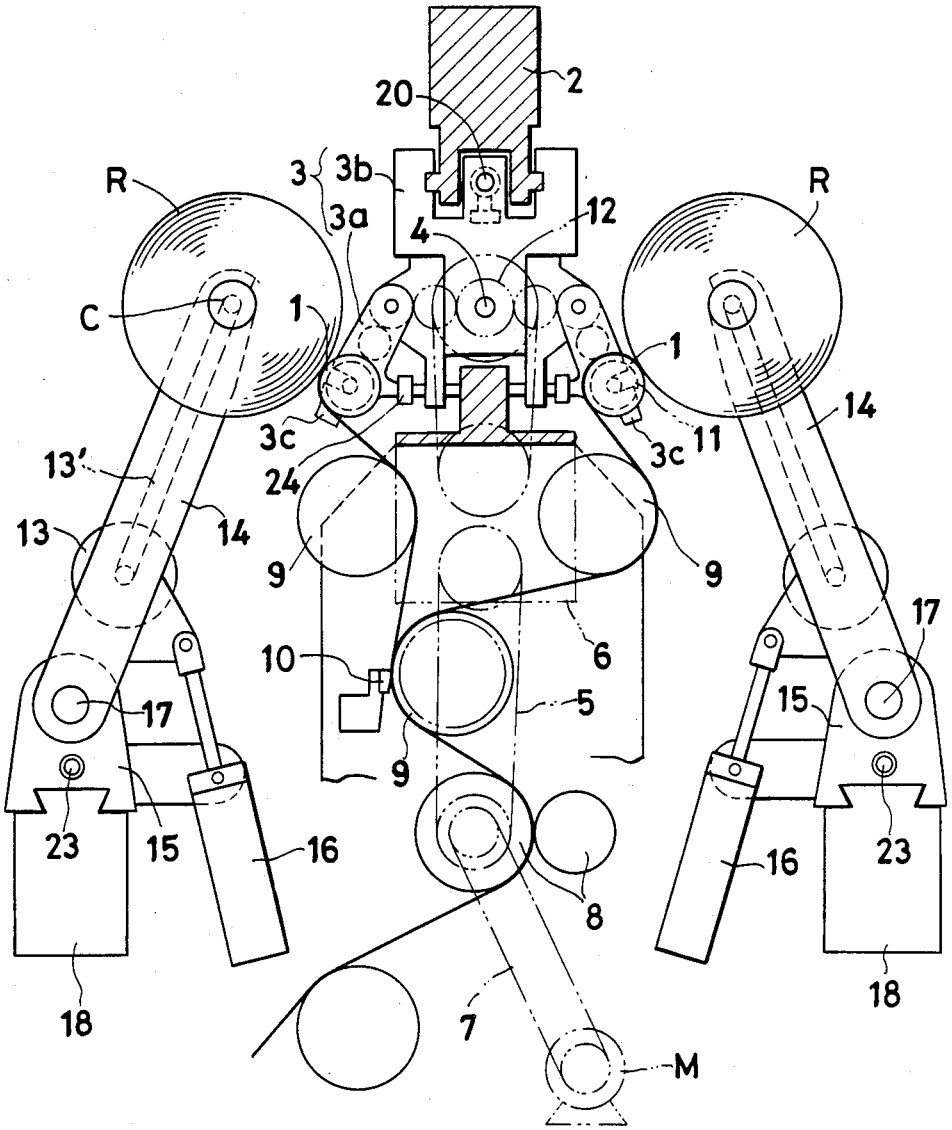
FIG. 5 is an outline of a side view of a second embodiment of the rewinder with slitter of the present invention.
Figure 6:
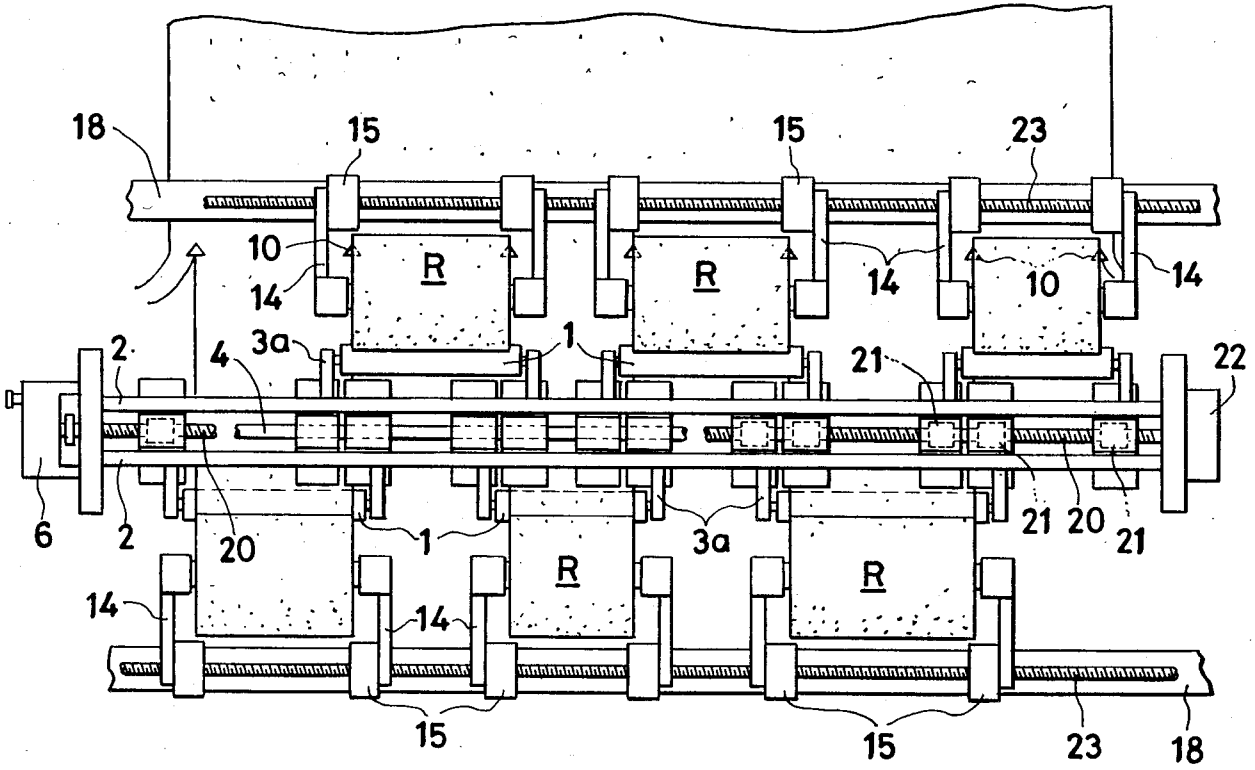
FIG. 6 is a plan view of the winder shown in FIG. 5.

The strip-like sheet S is fed from the unwinding rollers 8 to guide rollers 9 and the slitter blades 10 and slit thereby into narrow strip-like sheets S' which are alternately directed to the right and left by means of another guide roller 9 so that each of the slit sheets S' is wound on the winding core D into the sheet roll R via the touch rollers 1, said winding core D being supported on th winding axle C which is rotatably driven at a prescribed winding force by means of the driving mechanism 13 through the belt 13' while the winding axle C is supported by the winding arms 14, the touch rollers 1 being driven by the finely adjustable speed change mechanism 6 so as to be adjusted in their circumferential speed relative to the unwinding rollers 8. As shown in FIG. 4, a tension $t_1$ of the strip-like sheet S is apt to vary due to deformation of the material roll and the like, which tension $t_1$ produces an elastic stretch in the strip-like sheet S. Under such condition, if the strip-like sheet S passes through the unwinding rollers 8 and is slit by the slitter blade 10 to the prescribed width and wound on the winding axle C while it has the elastic stretch, the quality of the wound sheet roll R often becomes inferior due to a permanent strain produced in the sheets of the inner layer portion of the sheet roll R under the effect of the clamping force exerted on the sheets of such inner layer portion of the sheet roll R by the sheets of the outer layer portion of the sheet roll R, the clamping force being produced by the compressive force resulting from the residual stress of the thus-wound sheets, or the slit sheet S' immediately before it is wound is often deformed due to the irregularity in its thickness, producing wrinkling. Consequently, in consideration of the above facts, according to the present invention, the elastic stretch of the slit strip-like sheet S' is released by rotatably driving each touch roller 1 at a certain circumferential speed which is slightly different from the circumferential speed of the unwinding rollers 8, by means of the finely adjustable speed change mechanism 6, while the slit strip-like sheet S' passes around the small diameter touch roller 1 at a tension $t_2$ immediately before it is wound on the winding axle C. As a result, the radius of curvature of the slit sheet S' traversing the outer periphery of the touch rollers 1 is reduced so that the resistance of the slit sheet S' to deformation in the axial direction of the sheet roll R is increased while the slit sheet S' is brought into firm contact with the touch rollers 1 even when the tension thereof is small so that the slit sheet S' travels at a constant speed across its full width right up to when it is wound. Consequently, the wrinkling which is apt to be produced in the slit sheet S' immediately prior to winding is prevented from occuring, while the tension of the slit sheet S' is adjusted so that immediately before it is brought into contact with the touch rollers 1, which are driven, tension is $t_2$. The slit strip-like sheet S' fed to the winding axle C is wound, for example, at a tension $t_3$ which decreases gradually according to the increase of the sheet roll R by adjusting the torque of the winding axle C. Consequently, according to the present invention, irrespective of the tension of the sheet S before it is fed to the unwinding rollers 8, it is possible to form a high quality sheet roll R wthout the formation of wrinkling in the slit sheet S'.

Figure 7:
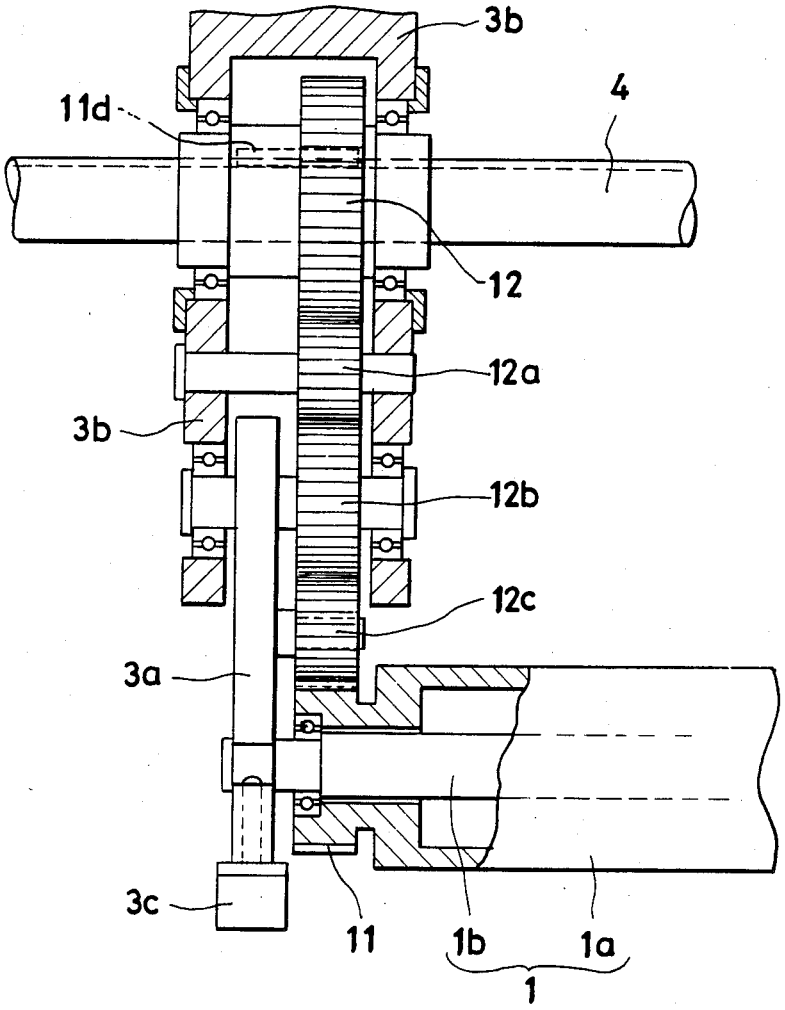
FIG. 7 is an enlarged view of the supporting arm of the winder shown in FIG. 5.

In FIGS. 5 to 8, there is shown a second embodiment of the rewinder with slitter of the present invention. A touch roller supporting frame 3 for supporting each touch roller 1 is constructed of: a supporting base **3*b* which is slidably connected to a lower portion of a base mount 2; and a supporting arm 3*a* an end of which is pivotally supported in a lower corner portion of the supporting base 3*b*. In an inner surface of each supporting arm 3*a* is provided a load cell 24. A plurality of the supporting frames 3 having the above construction is provided in the lower portion of the base mount 2. Each touch roller 1 is constructed of: a roller portion 1*a* contacting the sheet; and an axle portion 1*b* for rotatably supporting the roller portion 1*a*. End portions of each axle portion 1*b* of the touch roller 1 are inserted into grooves provided in the front ends of the supporting arms 3*a* and are prevented from dropping out by actuating hydraulic cylinders 3*c* provided in the same front end of each of the supporting arms 3*a* as shown in FIG. 7. A driving axle 4 for rotatably driving the touch roller 1 passes through the supporting base 3*b*** of the supporting frame 3. As shown in FIG. 7, a rotation driving mechanism for the touch rollers 1 is constructed of: a gear 12 which is slidably penetrated by the driving axle 4 to be supported by the supporting base 3*b* and is linked to the driving axle 4 by a sliding key lid; a gear 11 provided in the roller portion 1*a* of the touch roller 1; and three idler gears 12*a*, 12*b*, 12*c* provided between the gears 12 and 11, by which driving mechanism the roller portion 1*a* of the touch roller 1 is rotated by the driving axle 4.

Above and in parallel to the driving axle 4, a screw shaft 20 penetrates a screw shaft engagement/disengagement means 21 of each of the supporting bases 3*b*.

As shown in FIG. 8, the engagement/disengagement means 21 is constructed of: a female screw 21*a* meshing with the screw shaft 20; bearing portions 21*b* mounted on the supporting base 3*b* for limiting axial movement of the female screw 21*a*; and a hydraulic cylinder 21*c* which receives hydraulic pressure which advances its piston so that the piston is urged against an outer peripheral surface of the female screw 21*a* to prevent the female screw 21*a* from rotating. When the screw shaft 20 is rotatably driven by a screw shaft driving means 22 provided in an end of the screw shaft 20 while the female screw 21*a* is prevented from being rotated by actuating the hydraulic cylinder 21*c*, the female screw 21*a* is axially moved because of its engagement with the rotating screw shaft 20 so that the supporting base 3*b* is also moved in the axial direction of the screw shaft 20 with the axial movement of the female screw 21*a* to make it possible to adjust the distance between the adjacent supporting bases 3*b*. Incidentally, although the female screw 21*a* of the engagement/disengagement means 21 is frictionally engaged with the piston of the hydraulic cylinder 21*c*, it is also possible for the two to mesh-engage. Further, it is also possible to substitute for the engagement/disengagement means 21 one having a construction in which a conventional electromagnetic clutch is employed; or one having a construction in which a half-cut unit is employed to make it possible to perform an engaging/disengaging operation of such unit as required with respect to the screw shaft 20 instead of the employment of the female screw 21*a* having to be previously engaged with the screw shaft 20; or one having a construction in which the screw shaft 20 is fixed while the female screw 21*a*, which is meshed with the screw shaft 20, is rotatably driven by a suitable driving motor which is provided in each supporting frame 3.

In the rewinder with slitter having the above construction, when the width of the sheet S to be slit is determined, the supporting bases 3*b* of the supporting frames 3 are separately or simultaneously slid to a prescribed position along the base mount 2. Immediately after completion of such movement of the supporting base 3*b*, the touch rollers 1 are mounted between the front ends of the supporting frames 3*a* of the adjacent two supporting frames 3. Thus, the mounting operation of the touch rollers 1 is completed, said mounting operation being performable automatically or by remote control to make it possible for the touch rollers 1 to be easily mounted on the supporting arms 3*a* even when touch rollers 1 of different sizes are employed with respect to the individual sheet rolls R.

Also, in order to change the positions of the touch roller supporting frames 3, it is also possible to employ a rack provided along the base mount 2 while a pinion which meshes with the rack is provided in each of the supporting frames 3 to make it possible to move each of the supporting frames 3 along the base mount 2 by rotating the pinion manually by a handle or by motor.

Further, in place of the screw shaft 20 for moving the touch roller supporting frame 3, it is possible to employ separate screws one of which is for moving the supporting frame 3 exclusively in one direction, the other of which is for moving the supporting frame 3 exclusively in the other direction, and these screws do not have to penetrate the supporting frames 3.

In the above case, another screw shaft 23 penetrates the supporting base 15 for the winding arms 14 for supporting the sheet roll R. By rotating such screw shaft 23, it is possible to move the supporting base 15 along the base mount 18 to make it possible to mechanically adjust the distance between adjacent winding arms 14.

Figure 9:
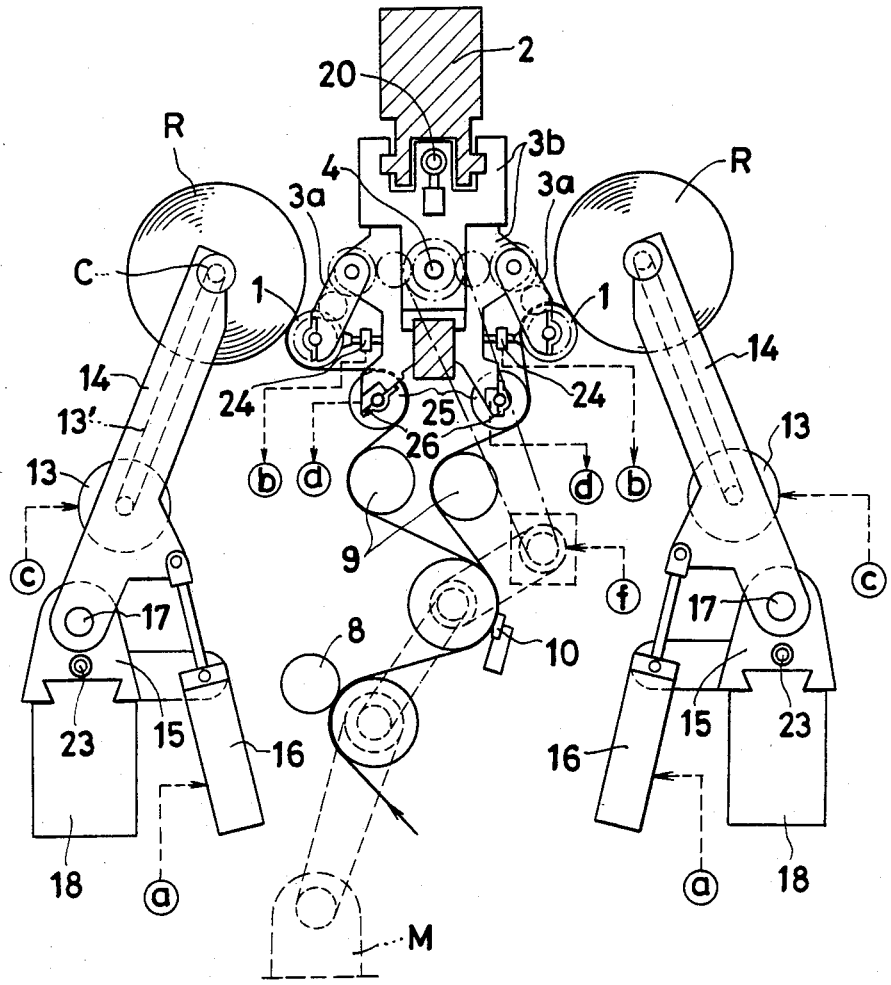
FIG. 9 is an outline of a side view of a third embodiment of the rewinder with slitter of the present invention.

FIGS. 9 and 10 show a third embodiment of the rewinder with slitter of the present invention, wherein the tension of the slit sheet S′ is detected immediately before it is wound, and, on the basis of the tension thus detected, the supply tension of the slit strip-like sheet S′ is controlled so as to further improve the winding condition quality of the sheet roll R. The rewinder with slitter of this third embodiment differs from that of the second embodiment in that, there are additionally provided a detecting roller 25 for detecting the tension of the slit sheet S′ between the unwinding rollers 8 and the touch rollers 1, and a load detecting means 26 for detecting the load on the detecting roller 25, said rollers 25 and means 26 being provided in each of the opposite lower end portions of the supporting base 3*b* of the supporting frame 3 of the rewinder with slitter of the second embodiment of the present invention. The length of the detecting roller 25 corresponds to the width of the slit sheet S′, and the detecting roller 25 is provided upstream of the touch rollers 1 so that the slit sheet S′ passes around the detecting roller 25 to make it possible to detect the tension of the slit sheet S′ through the load detecting means 26.

It is also possible to support the load detecting means 26 for the detecting roller 25 by means of the supporting arm 3*a* of the supporting frame 3 in place of the supporting base 3*b* of this embodiment.

As for the rewinder with slitter having the above construction, now will be described how to control the tension of the slit sheet S′ immediately before it is wound.

Figure 11:
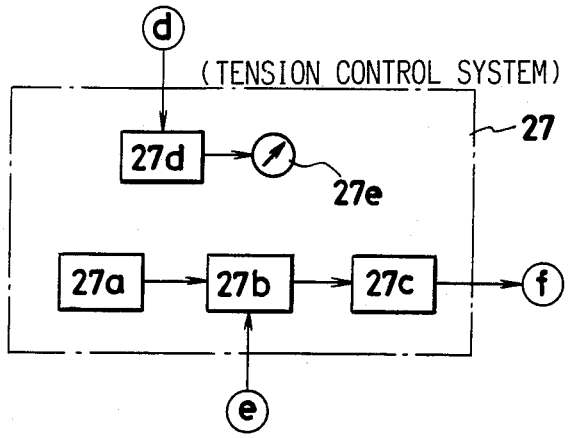
FIG. 11 is a block diagram of a tension control system of the winder shown in FIG. 9 for the sheet fed thereto.

The tension of the slit sheet S′ between the touch rollers 1 and the unwinding rollers 8 is determined on the basis of the rotation speed of the touch rollers 1, and an instruction signal "f" to be fed to the finely adjustable speed change mechanism 6 of the touch roller 1 is issued from a sheet supplying tension control device 27, the construction thereof as shown in FIG. 11 consisting of a setting portion 27*a* for setting a constant which determines characteristics of a pattern of the supply tension; a calculating portion 27*b* for comparing the above constant with a winding development signal "e" issued thereto as a variable to prepare and issue a prescribed signal of the supplying tension as its output; and an interface portion 27*c* which receives the supply tension signal and amplifies same to prepare and issue the instruction signal "f" to the finely adjustable speed change mechanism 6.

It is possible, as such winding development signal "e", to employ, for example, a signal representing the length of the slit sheet S′ having been wound, said length signal being prepared by counting as pulses the rotations of the unwinding rollers 8; a signal representing the diameter of the sheet roll R obtained by detecting the angle of the supporting arms 14 of the winding axle C by use of a potentiometer and the like, as the arms 14 swing further away from the touch roller 1 as the roll diameter increases; or a signal representing the diameter of the sheet roll R calculated in a sheet roll diameter detecting device (not shown) on the basis of the length of the slit sheet S' that has been wound and the thickness of the slit sheet S', or the travelling speed of the slit sheet S' and the rotation speed of the winding axle C, or the total number of rotations of the winding axle C and the thickness of the slit sheet S'.

In the calculating portion **27*b* of the control device 27, the constant issued from the setting portion 27*a* of the control device 27 is compared with the winding development signal "e" so that the instruction signal "f" is prepared and issued to the finely adjustable speed change mechanism 6 to make it possible to keep the tension of the slit sheet S' in its optimum condition between the touch roller 1 and the unwinding rollers 8**.

The reference numeral **27*d* designates a display portion for displaying on a display terminal 27*e* the value of a sheet tension detection signal "d" issued from the load detecting means 26 which is provided in each of the detecting rollers 25. Consequently, it is possible to clarify the actual tension of the slit sheet S' immediately before it is wound, by means of the display terminal 27*e***, so that a manageability of the rewinder with slitter of the present invention is enhanced.

It is possible to manually operate the finely adjustable speed change mechanism 6 while observing the display terminal **27*e*** indicates the value of the detection signal "d" representing the actual tension of the slit sheet S' immediately before it is wound.

Further, as shown in FIG. 14, it is also possible for the finely adjustable speed change mechanism 6 to be provided in each of the touch rollers 1 and the detection signal "d" to be fed back to the calculating portion **27*b* of the control device 27 of each finely adjustable speed change mechanism 6, so that the constant issued from the setting portion, a variable representing the winding development signal "e" and another variable representing the sheet tension detection signal "d" are compared in the calculating portion 27*b* of th control device 27 to make it possible to prepare and issue the signal "f" to each finely adjustable speed change mechanism 6, making it possible to remarkably enhance the control precision of the rewinder with slitter of the present invention. Further, although it is preferably to keep the supply tension at a constant value, in case that the strip-like sheet S is made of a special material or a special winding tightness of the sheet roll R is required, it is necessary to change the supply tension in accordance with the progress in the winding of the sheet roll R. Consequently, if it is sufficient to keep the supply tension at a constant value, it is not necessary to feed the winding development signal "e" to the control device 27**.

As the mechanism for automatically operating the finely adjustable speed change mechanism 6 on the basis of the output signal of the sheet supply tension control device 27 as in the case of this embodiment, it is possible to employ a stepless speed change mechanism provided with a pilot motor; a stepless speed change mechanism for changing the ratio of speed reduction by means of a servomechanism; or another type of stepless speed change mechanism for continuously operating a differential gear by means of a variable speed motor.

The winding quality of the sheet roll R is substantially determined by the tension (sheet supply tension) of the slit sheet S' immediately before it is wound; the contact pressure between the sheet roll R and the touch roller 1; and the winding tension of the slit sheet S' produced by the torque of the winding core D. Since the control techniques of two elements, i.e. the contact pressure and the winding tension, are more developed than the control technique of the other element, i.e. the supply tension, it is possible to enhance the winding quality of the sheet roll R by combining the control techniques of the former two elements with that of the latter element, and more preferably it is necessary to precisely control these three elements in combination in order to wind the slit sheet S' in a high quality condition.

Figure 12:
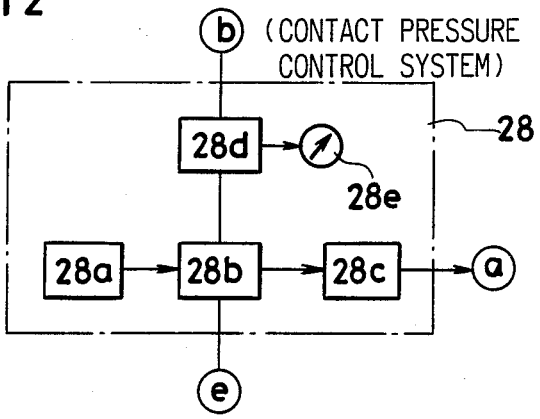
FIG. 12 is a block diagram of a contact pressure control system of the winder shown in FIG. 9 for the sheet.
Figure 13:
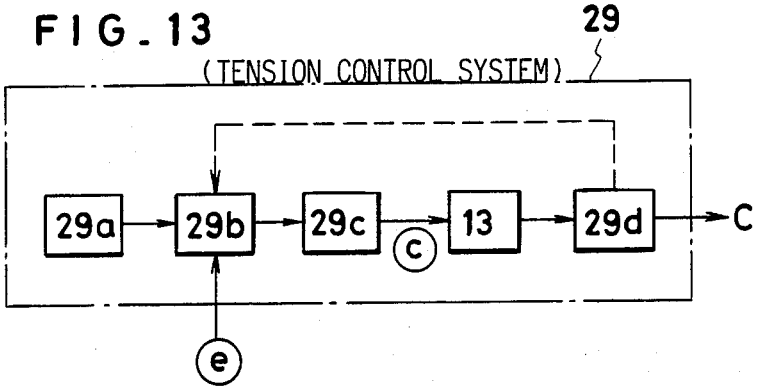
FIG. 13 is a block diagram of a tension control system of the winder shown in FIG. 9 for the sheet.

An example of a control device 28 for controlling the above contacting pressure is shown in FIG. 12, while a control device 29 for controlling the sheet supply tension is shown in FIG. 13.

The control device 28 for controlling the contacting pressure is constructed of a setting portion 28a for setting a constant determining the characteristics of the contact pressure pattern in consideration of the properties of the material of the strip-like sheet S and the amount of the slit sheet S' which has been wound; a calculating portion **28*b* for comparing the constant fed from the setting portion 28*a* with a variable representing the winding development signal "e" which is continuously fed so that an output signal for keeping the contacting pressure at a prescribed value is prepared and issued; an interface portion 28*c* for receiving and amplifying the output signal issued from the calculating portion 28*b* to prepare and issue a signal "a" for actuacting a certain hydraulic cylinder 16; a display portion 28*d* for receiving and displaying a detection signal "b" of the contacting pressure between the touch roller 1 and the sheet roll R, which detection signal "b" is detected by the load cell 24 of each touch roller 1; and a display termainal 28*e* of the display portion 28*d***. With respect to the winding development of the sheet roll R, the contact pressure is so controlled in the winding operation that it is kept at a constant value or tends to increase.

Although it is possible to simply display the detection signal "b" of the contact pressure on the display terminal **28*e* so that the manageability and the operational efficiency of the rewinder with slitter of the present invention are enhanced, such detection signal "b" is preferably fed back to the calculating portion 28*b* so that the control precision of the winder of the present invention is enhanced in this embodiment. Namely, in the calculating portion 28*b* of the control device 28, three elements, i.e. the constant which is set in the setting portion 28*a*, the variable representing the winding development signal "e" and another variable representing the detection signal "b" of the contact pressure are compared so that the instruction signal "a" for performing a prescribed operation is prepared and fed to the hydraulic cylinder 16 to control the contact pressure between the sheet roll R and the touch roller 1**, whereby the contact pressure is kept at an optimum value.

An example of a construction of a sheet winding tension control device 29 is shown in FIG. 13, and consists of a setting portion **29*a*** and a calculating portion 29*b*, both of which are identical with the setting portion 28*a* and the calculating portion 28*b* of the control device 28, respectively; and an interface portion 29*c* for receiving and amplifying an output signal issued from the calculating portion 29*b* to prepare and issue an output signal "c" for driving the driving mechanism 13 of a winding axle supporting body at a prescribed torque. Incidentally, since the control device 29 does not detect the actual tension of the slit sheet S', it is necessary to enhance the tension control precision of the rewinder with slitter of the present invention by providing a torque detection device 29*d* in the drive train between the driving mechanism 13 and the winding axle C or the winding core D so that a detection signal issued from the torque detection device 29*d* is fed back to the calculating portion 29*b* to enhance the control precision of the rewinder with slitter of the present invention.

As described above, in the calculating portion 29*b*, the constant issued from the setting portion 29*a* , the variable representing the winding development signal "e" and the detection signal issued from the torque detection device 29*d* are compared so that the instruction signal "c" is prepared and issued to the driving mechanism 13 for the winding axle C, whereby the sheet roll R is controlled to be rotated at the prescribed torque.

The contact pressure and the sheet winding tension are controlled by actually detecting two elements, i.e. the contact pressure and the torque of the winding axle C, so that the detected value of these two elements are fed back to be controlled, whereby the rewinder with slitter of the present invention is more accurately controlled.

As described above, three elements, i.e. the supply tension of the slit sheet S' fed to the sheet roll R for winding; the contact pressure between the sheet roll R and the touch roller 1; and the winding tension of the slit sheet S' produced by the torque of the winding core D are each appropriately controlled so that the tension of the slit sheet S' is adjusted to the prescribed level immediately before it is wound irrespective of the unwinding tension, etc. produced in the sheet S when it is being unwound from its material roll, whereby the slit sheet S' the supply tension of which has been adjusted is wound to form a high quality sheet roll R in which an adequate amount of air exists between the windings of the slit sheets S' each of which has adequate tension.

While in the rewinder with slitter of the above embodiment of the present invention a driving mechanism 13 is provided in each winding axle C on which the slit sheet S' is wound to form a sheet roll R which is brought into contact with touch rollers 1 which are held in a fixed position during the winding operation of the sheet roll R, and as the winding of the sheet roll R progresses each of the winding axles C is individually moved to provide separation from the touch rollers 1, the rewinder with slitter of the following fourth embodiment of the present invention has a construction in which the touch rollers 1 are moved according to the progress in the winding of the sheet roll R.

Figure 15:
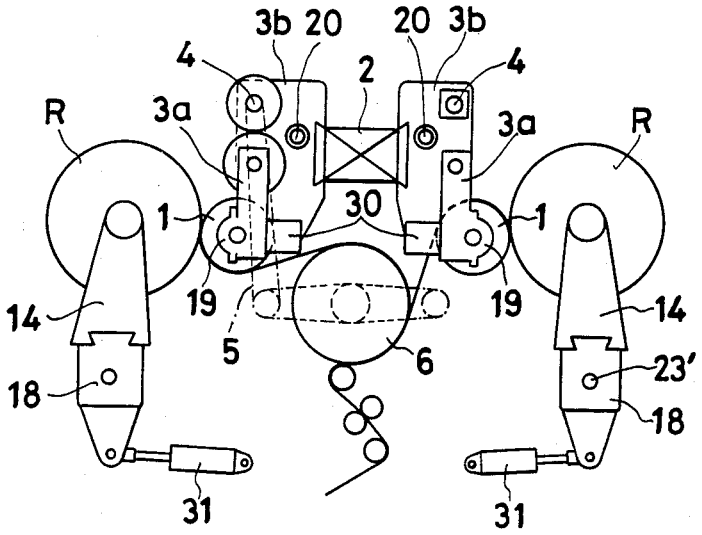
FIG. 15 is an outline of a fourth embodiment of the rewinder with slitter of the present invention.
Figure 16:
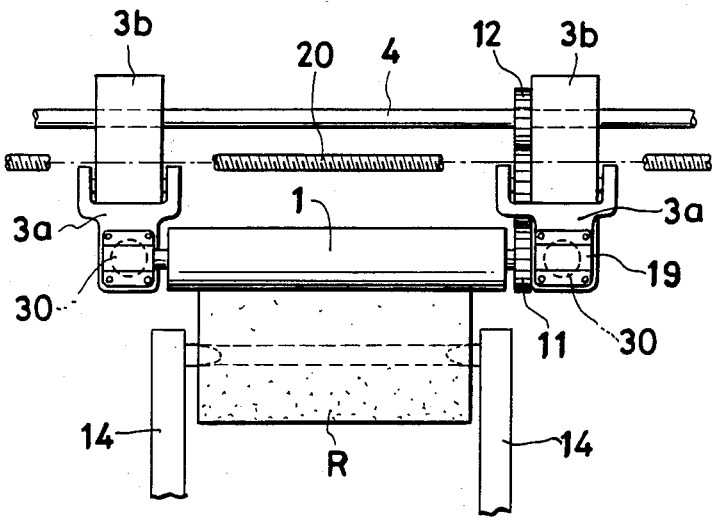
FIG. 16 is a plan view of the principal parts of the winder shown in FIG. 15.

The rewinder with slitter of a fourth embodiment of the present invention is shown in FIGS. 15 and 16, in which the supporting frame of each touch roller 1 provided at each side of the base mount 2 consist of the supporting base 3*b*; and the supporting arm 3*a* which is pivotally supported by the supporting base 3*b* at one end and is provided with a touch roller supporting means 19 at the other end thereof for holding the touch roller 1. In the supporting base 3*b* is provided a hydraulic cylinder 30 the front end of the piston of which is connected to the supporting arm 3*a* to enable the piston of the hydraulic cylinder 30 to urge the supporting arm 3*a* so as to adjust the contact pressure between the touch roller 1 and the sheet roll R. In place of the hydraulic cylinder 30 it is possible to employ a spring means. Further, in this embodiment, though each touch roller 1 is supported at its ends by a supporting arm 3*a* , it is also possible to integrally form each pair of supporting arms 3*a* into a U-shaped arm which supports the touch roller 1 at its front ends to form a monobloc structure making it possible to change each touch roller 1 as a unit, so the touch roller 1 is always of the proper length.

By a provision of hydraulic cylinder 31 for swinging the base mount 18 which guides and supports the winding axle supporting arms 14 provided in the width direction of the strip-like sheet S, each of the winding arms 14 is turned about an axle 23' together with the base mount 18 to enable the sheet roll R to be moved toward or away from the touch roller 1, said axle 23' penetrating the base mounts 18.

As described above, since the hydraulic cylinders 30, 31 perform both the control of the load applied to the winding arm 14 in accordance with the development of the sheet roll R and the control of the contact pressure between the touch roller 1 and the sheet roll R, it is possible to precisely control the contact pressure between the touch roller 1 and the sheet roll R.

In this embodiment, the screw shaft 20 is provided in each of the opposite sides of the base mount 2 to which the slit sheets are distributed, and in the base mount 2 it is possible to move the supporting frames 3 (3*a*, 3*b*) independently.

Figure 17:
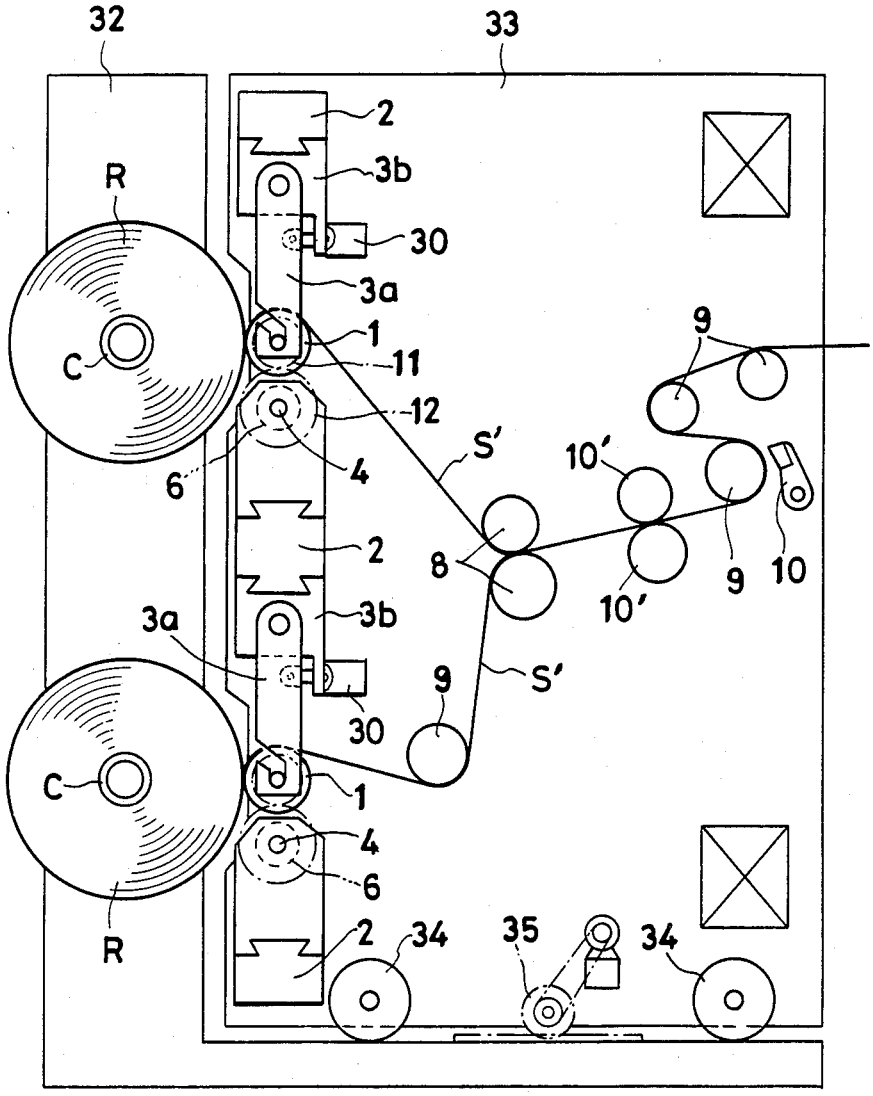
FIG. 17 is an outline of a side view of a fifth embodiment of the rewinder with slitter of the present invention.
Figure 18:
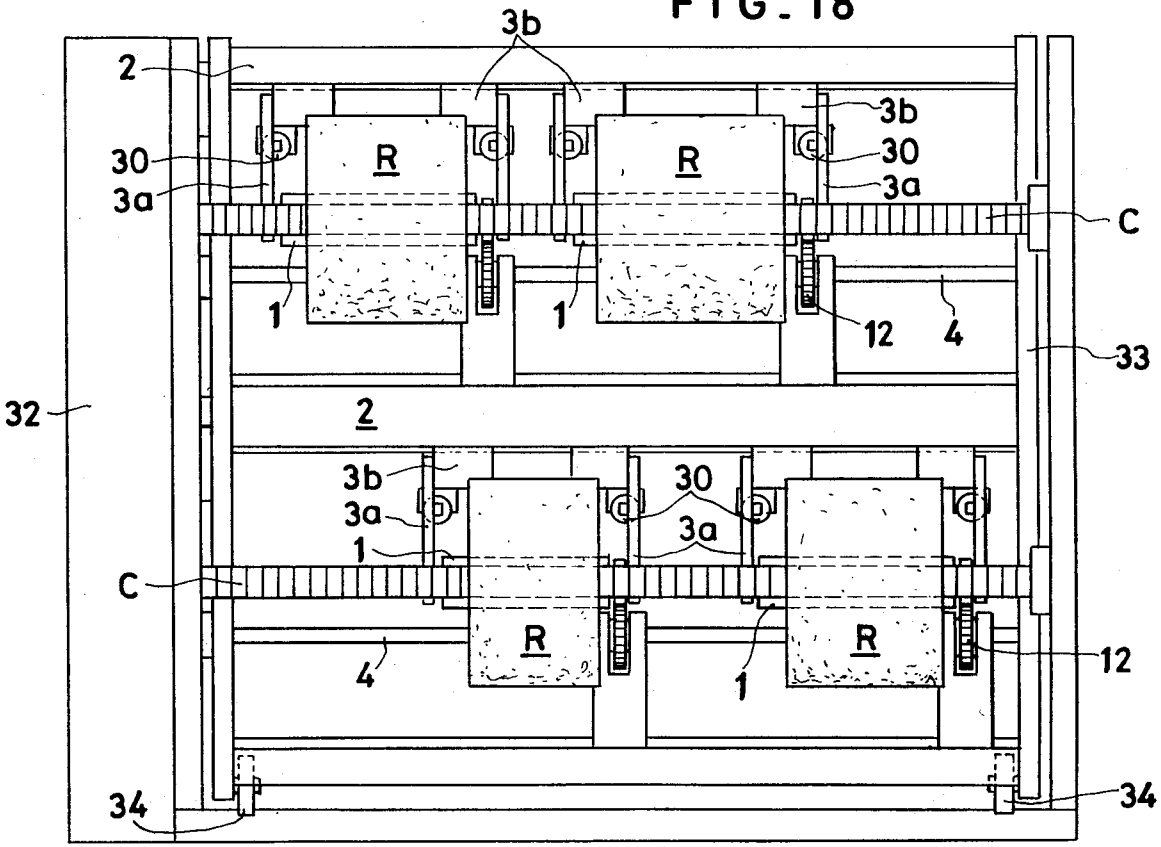
FIG. 18 is an outline of a front view of the winder shown in FIG. 17.
Figure 19:
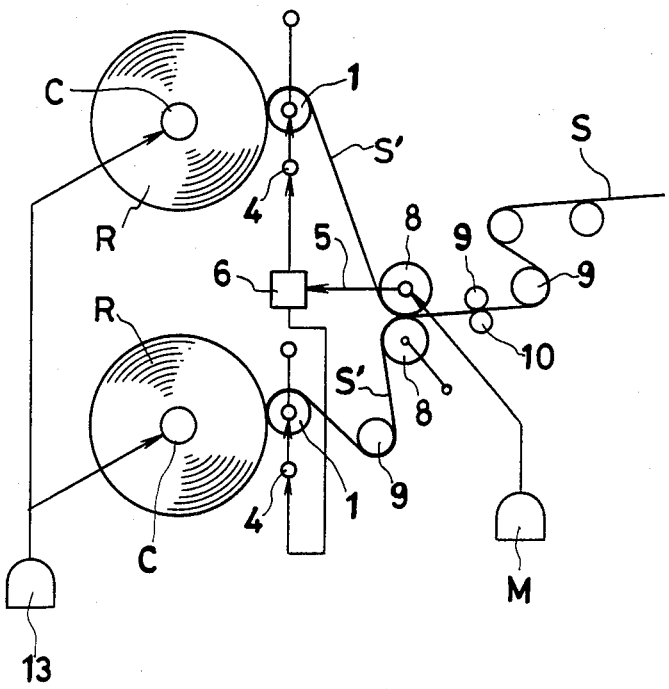
FIG. 19 is an outline of the driving system of the winder shown in FIG. 17.

In the rewinder with slitter according to a fifth embodiment of the present invention, shown in FIGS. 17 to 19, two winding axles C for winding the sheet rolls R thereon are detachably mounted at an upper and lower portion between two opposed side walls of an outer frame 32, the winding axle C being rotated by suitable means so that the slit sheets S' are wound on the winding axles C. Between the opposite side walls of the outer frame 32 are provided inner frames 33 which are supported by wheels 34 provided at the bottom portions of the inner frames 33 so as to be movable to and fro, while a driving mechanism 35 for moving the inner frames 33 toward or away from the outer frame 32 is provided between the outer frame 32 and the inner frames 33 to make it possible to move the inner frames 33 toward or away from the winding axles C. Between these two inner frames 33 are provided base mounts 2 which are mounted in upper, middle and lower portions of the inner frames 33, respectively. A plurality of supporting bases 3*b* are slidably supported in the lower surfaces of the base mounts 2 mounted on the upper and middle portions of the inner frames 33, and in each of the supporting bases 3*b* are pivotally supported a pair of supporting arms 3*a* in the front ends of which the touch roller 1 is rotatably held, while a hydraulic cylinder 30 is provided in each of the supporting arms 3*a* to adjust the contact pressure between the touch roller 1 and the sheet roll R. Supporting bases for supporting the driving axles 4 of the touch rollers 1 are inserted into the middle and lower portions of the inner frames 33 so that the rotation of each of the driving axles 4 is transmitted to each of the touch rollers 1 through the gears 11, 12.

Further, between the inner frames 33 there are provided unwinding rollers 8, guide rollers 9, slitter blades 10, and circular slitter blades 10', so that the strip-like sheet S is guided to the slitter blades 10 via guide rollers 9 and slit into sheets S' of the prescribed widths, and the slit sheets S' are vertically distributed to be wound on the winding axles C via the touch rollers 1 which are brought into contact with the sheet rolls R at prescribed contact pressures. FIG. 19 shows a driving system of the rewinder with slitter of this embodiment of the present invention.

As the winding of the slit sheet S' on the sheet roll R progresses, the inner frames 33 are gradually moved rearward, away from the sheet roll R, by the driving mechanism 35 which moves the outer frame 32 on the basis of a detected signal indicating the winding progress of the sheet roll R, so that the swing angle of the supporting arms 3*a* of the supporting frame 3 for the touch roller 1 is kept at a constant value. As a means for detecting the winding progress of the sheet roll R, it is possible to employ a photoelectric switch; a proximity switch; or a computor for calculating such progress on the basis of data such as the thickness of the strip-like sheet S, the length of the slit sheet S' wound on the winding axle C, and the diameter of the sheet roll R which is formed by the winding of the slit sheet S' on the winding axle C.

Although in this embodiment the winding axle C is mounted on the stationary outer frame 32, it is possible to obtain the same effect as that obtained in an embodiment in which the winding axle C is mounted on the movable inner frames 33 which are moved to and fro. Further, in case the touch roller 1 is urged against the winding axle C under the effect of its own weight, it is possible to eliminate the control device for adjusting the contact pressure between the touch roller 1 and the winding axle C or the sheet roll R.

As the driving mechanism 35 for moving the inner frames 33 toward or away from the outer frame 32, it is possible to employ a hydraulic cylinder unit; a rack-and-pinion unit in which the rack is mounted on the outer frame 32 and is held stationary while the wheels 34 in the bottom portions of the inner frames 33 forming the pinions, mesh with the rack and are rotated by a motor; or a screw-nut unit in which the nut is provided on the inner frames 33 and the screw is provided on the outer frame 32 and is held stationary in its axial direction, the screw being engaged with the nut and reversibly rotated by a motor. Further, although the touch roller 1 is supported at its ends by a pair of the supporting arms 3*a* in this embodiment, it is also possible, in order to keep the touch roller 1 parallel to the winding axle C, for the base portions of the supporting arms 3*a* ends of the touch roller 1 to be integrally connected with each other to form a U-shaped member which supports the touch roller 1 at its front end to form a unit in which the touch roller 1 is integrally incorporated, so that it is possible to replace the touch roller 1 by replacing such unit.

In the rewinder with slitter of this embodiment of the present invention, a plurality of the slit sheets S' are wound on the winding axles C so that the thus formed sheet rolls R differ in their outer diameter from each other during their winding operations due to differences in the thickness of the slit sheets S'. However, since there is provided a hydraulic cylinder 30 in each of the supporting frames 3 to make it possible to adjust the contact pressure between each touch roller 1 and sheet roll R, there is no fear that the said contact pressure increases, in the case of larger diameter sheet rolls R, so that it is possible to prevent the winding quality of the product sheet roll R from being deteriorated.

Figure 20:
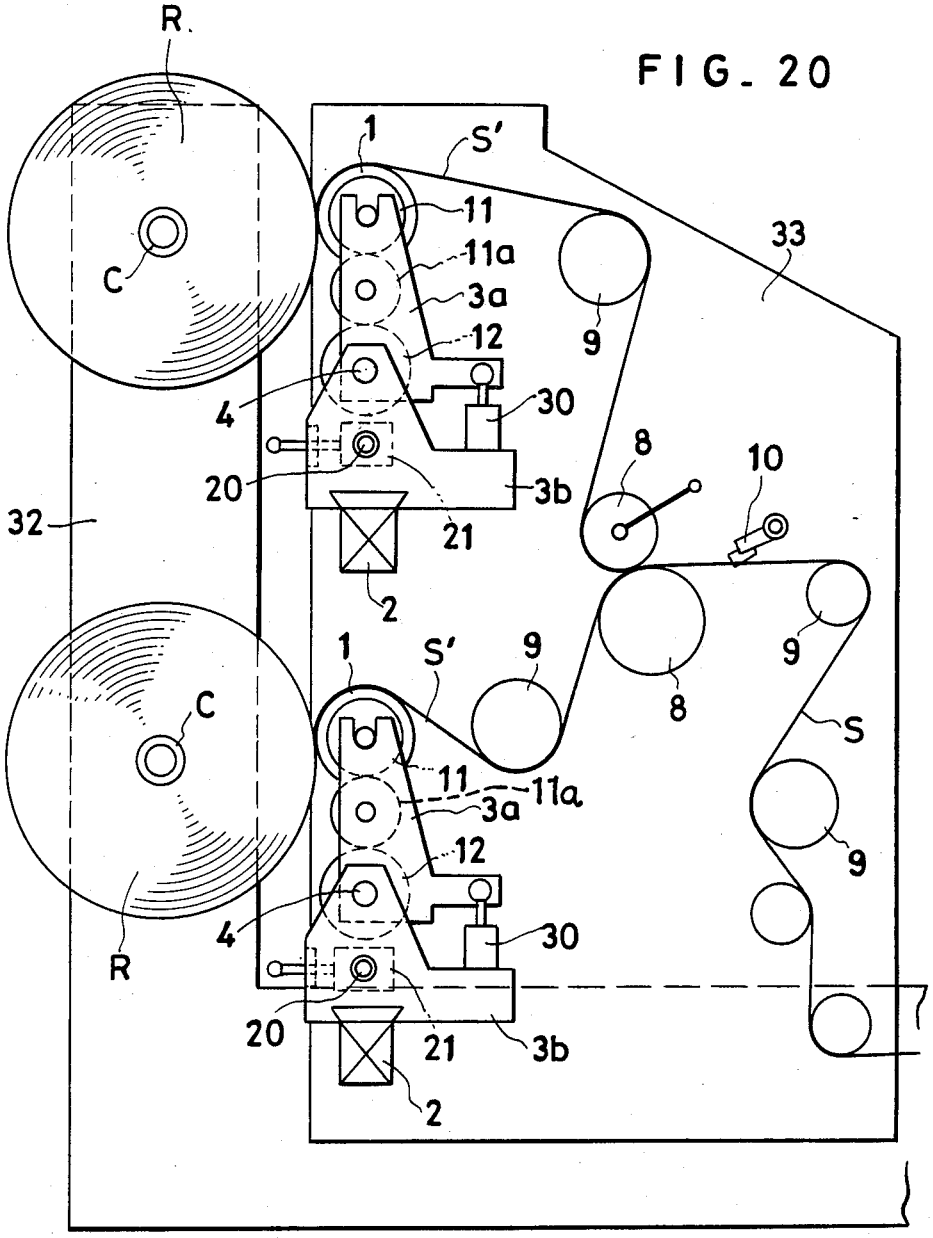
FIG. 20 is an outline of a side view of a sixth embodiment of the rewinder with slitter of the present invention.

As shown in FIG. 20, the rewinder with slitter of a sixth embodiment of the present invention is a simple modification of the fifth embodiment of the present invention. In the sixth embodiment, base mounts 2 for supporting the touch roller 1 are mounted on the upper and lower portions of the inner frames 33 and between the opposite walls thereof, and in the base mounts 2 are longitudinally provided a plurality of slidable supporting bases 3*b* each of which swingably supports at one end a touch roller supporting arm 3*a* . Each of the supporting arms 3*a* is provided with a gear 11*a*. The rotational movement of the driving axle 4 which penetrates the supporting arms 3*a* is transmitted to the touch roller 1 via the gears 12, 11*a*, 11.

Between each supporting base 3*b* and each supporting arm 3*a* is provided a hydraulic cylinder 30 for adjusting the contact pressure between sheet roll R and touch roller 1. Further, the supporting bases 3*b* are penetrated by a screw shaft 20, so that it is possible to move each of the supporting bases 3*b* to a desired fixing position on the base mount 2 by operating the screw shaft engagement/disengagement means 21 which is provided in each of the supporting bases 3*b*.

Figure 21:
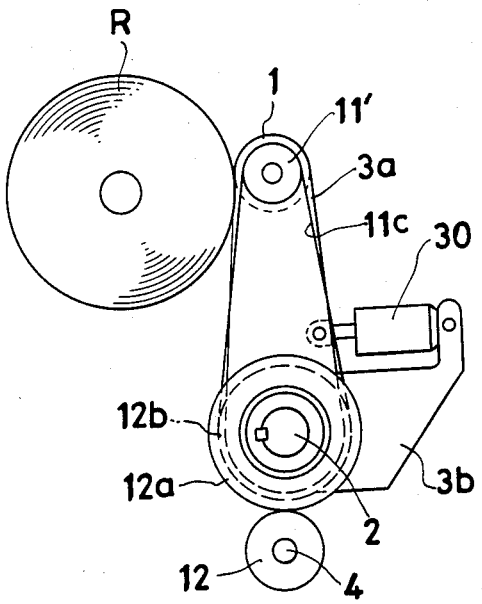
FIG. 21 is a side view of the principal parts of a seventh embodiment of the rewinder with slitter of the present invention.
Figure 22:
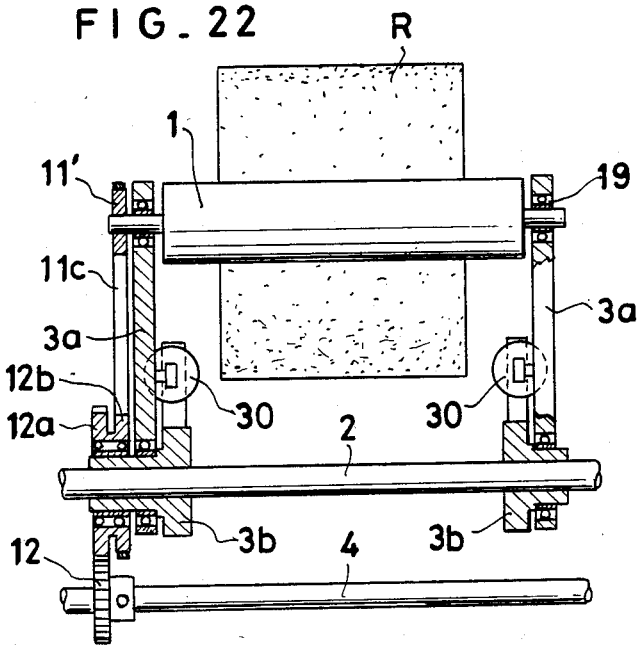
FIG. 22 is a sectional view of the supporting arm for the touch roller of the winder shown in FIG. 21.

Although in the above fifth and sixth embodiments of the present invention, the inner frames 33 are gradually or continuously moved linearly on the outer frame 32 according to the development of the sheet roll R formed of the slit sheet S' on the winding axle C, it is also possible for each of a series of winding axles C to be supported at their ends changeably between free ends of a pair of swinging arms which are swingable at their base portions which act as fulcrums for such swinging movements so that such swinging arms are gradually or continuously swung according to the development of the diameter of the sheet roll R on each of the winding axles C on which the slit sheets S' are wound, as shown in FIGS. 21 and 22 which show the rewinder with slitter of a seventh embodiment of the present invention which is described in detail hereinbelow.

A circular column 2, which acts as the base mount 2, and a driving axle 4 are each provided at upper and lower portions of the inner frames 33 and held therebetween so as to be separated from each other and parallel. In a plurality of supporting bases 3*b* is inserted the circular column 2, each of the supporting bases 3*b* being rotatably inserted into one end of the supporting arm 3*a* which is provided with a supporting means for the touch roller 1 in the other end thereof, so that the contact pressure between the sheet roll R and the touch roller 1 is adjusted by the hydraulic cylinder 30. The gear 12 is fixed to the driving axle 4 so that the rotational movement of the driving axle 4 is transmitted to the touch roller 1 via gears 12 and 12*a*, pulley 12*b*, belt 11*c*, and pulley 11'. In the rewinder with slitter having the above construction, without moving the inner frames 33 rearward, it is possible to proceed with the winding operation of the slit sheet S' by merely swinging the supporting arms 3*a* while the hydraulic pressure of the hydraulic cylinder 30 is kept at a prescribed value, according to the development of the sheet roll R formed of the wound slit sheet S'.

Figure 23:
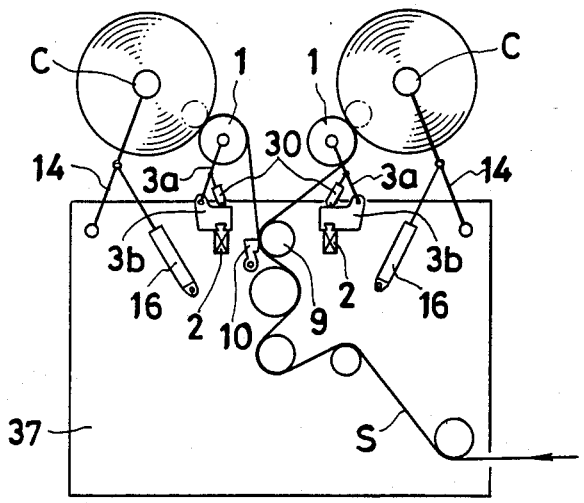
FIG. 23 is an outline of a side view of an eighth embodiment of the rewinder with slitter of the present invention.
Figure 24:
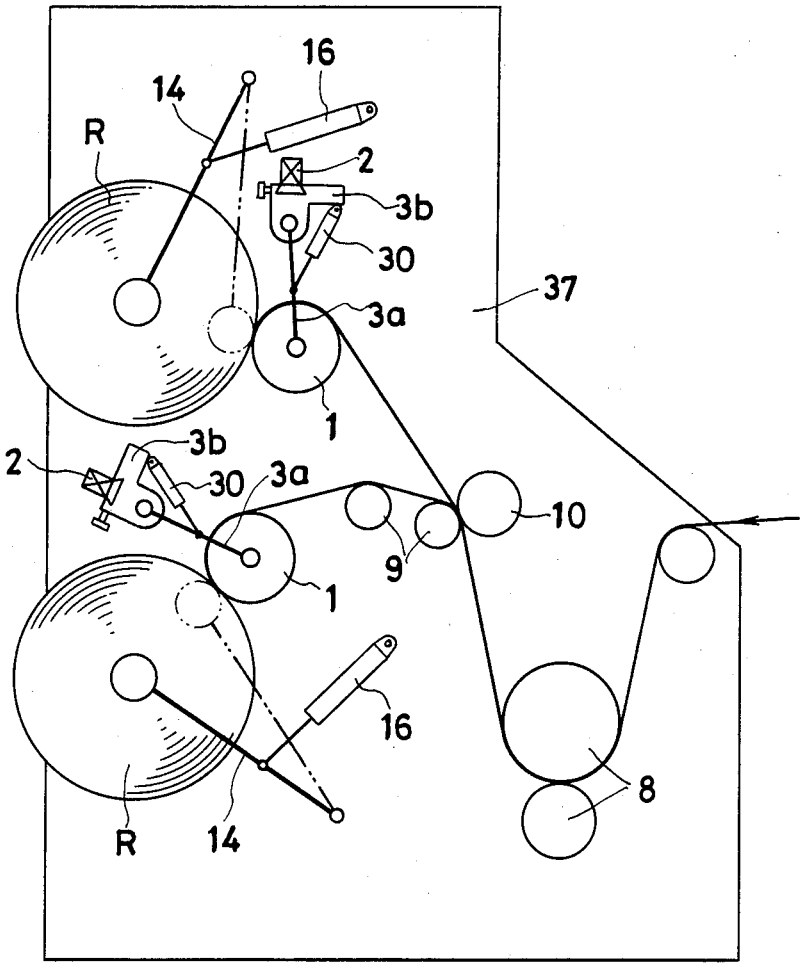
FIG. 24 is an outline of a side view of a modification of the winder shown in FIG. 23.

The construction of the rewinder with slitter of the embodiment of the present invention shown in FIG. 24 is substantially identical with that of the embodiment of the present invention shown in FIG. 23, though in the latter embodiment the winding axles C are provided on a stationary frame 37 to place the touch rollers 1 therebetween so as to face each other, while in the former embodiment the winding axles C mounted between the stationary frames 37 are vertically facing each other and the touch rollers 1 are laterally brought into contact with the sheet roll R.

Although in both of the above embodiments of the present invention a pair of the winding arms 14 in the free ends of which is supported winding axle C on which the slit sheet S' is wound are swung according to the development of the sheet roll R formed of the wound slit sheet S' so that the sheet roll R is moved away from the touch rollers 1, it is also possible to move the touch roller 1 away from the sheet roll R by keeping the winding axle C in a fixed position.

Figure 25:
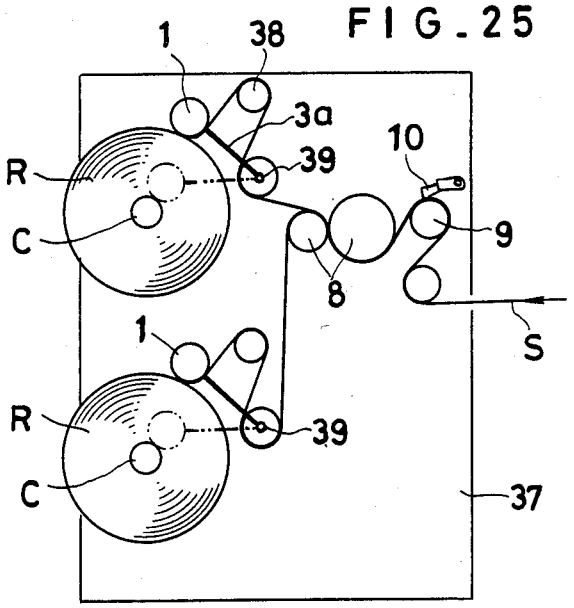
FIG. 25 is an outline of a side view of a ninth embodiment of the rewinder with slitter of the present invention.
Figure 26:
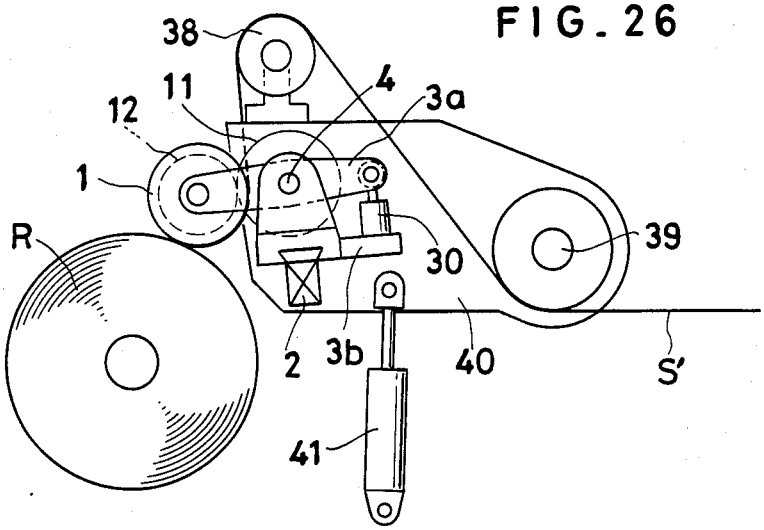
FIG. 26 is an enlarged side view of the supporting frame for the touch roller of the winder shown in FIG. 25.
Figure 27:
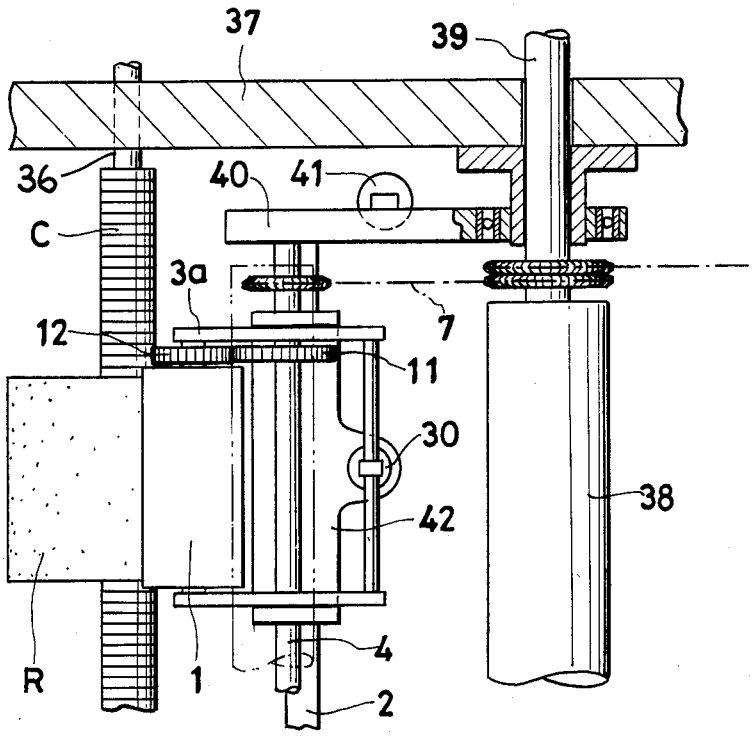
FIG. 27 is an enlarged plan view of the supporting frame for the touch roller of the winder shown in FIG. 25.

Such an embodiment is shown in FIGS. 25 to 27, in which the winding axle C is changeably provided in the upper and lower portions of the opposite stationary frames 37 and held therebetween.

Between the stationary frames 37 is provided a fulcrum axle 39, which also acts as a guide roller with respect to each of the winding axles C, in opposite ends of which fulcrum axle 39 are swingably mounted a pair of swinging arms 40, while between a pair of the supporting arms 3*a* there is provided the base mount 2. Each supporting base 42 which can slide along the base mount 2 the number of which is identical with that of the supporting arms 3*a* is fixed to the base mount 2 by means of a setscrew. The supporting arm 3*a* is swingably mounted at its middle portion on the supporting base 42 through the driving axle 4 which is mounted between swinging arms 40. The touch roller 1 is rotatably mounted between the ends of the two supporting arms 3*a* , while the hydraulic cylinder 30 is mounted between the other ends of the supporting arms 3*a* and the supporting base 42. The gear 11, which is slidably mounted on the driving axle 4 through a suitable means such as a setscrew, is meshed with the gear 12 mounted on an end of the touch roller 1. Incidentally, in a transmission system for transmitting the rotational movement of the unwinding roller 8 to each of the driving axles 4 through the finely adjustable speed change mechanism 6, such rotational movement is transmitted to each of the fulcrum axles 39 and then to each of the driving axles 4 through an intermediate transmission device 7.

Since the rewinder with slitter of this embodiment of the present invention has the above construction, it is possible to adjust the contact pressure between the touch rolle 1 and the sheet roll R to an optimum value by moving the pair of the swinging arms 40 gradually or continuously by means of a hydraulic cylinder 41 according to the winding development of the sheet roll R so that all the touch rollers 1 are simultaneously moved away from the sheet rolls R while the supporting arms 3*a* are operated by the hydraulic cylinders 30 according to variations in the thickness of the slit sheet S' and in diameter of the sheet roll R which is formed of the slit sheet S' on the winding axle C. As shown in the drawings, if the slit sheet S' is guided to the touch roller 1 from a series of guide rollers 38 provided in the fulcrum axles 39, it is possible to provide such series of the guide rollers 38 between the swinging arms 40, if necessary.

Further, the winding axle C consists of a central axle 36 and a plurality of adjacent rings in parallel to each other and mounted on the outer periphery of the central axle 36, i.e. the central axle passes through the rings. Between an outer periphery of the rings and an inner periphery of the winding cores D there is provided a one-way clutch provided with ratchet-type blades or ratchet-type rotary elements. Said inner periphery of rings and outer periphery of the central axle 36 of the winding axle C are provided with frictional members the frictional force between which is adjusted to make it possible to transmit the torque of the central axle 36 of the winding axle C to the above rings. Consequently, the longer the winding core D extends in its axial direction, the more outer rings the winding core D passes through, so that it is possible to automatically transmit the prescribed winding torque to the winding core D from such rings. This frictional transmission of the winding torque may be performed by a conventional friction-type winding axle, or another conventional type winding axle such as proposed in Japanese Patent Application No. SHO 60-41193 or No. SHO 59-159092.

Although several embodiments of the present invention have been described in the above, it is of course possible to appropriately modify these embodiments by use of well-known techniques.

For example, the slit sheet S' distributed to one side of the base mount 2 may be further distributed to a plurality of places. Further, it is possible to locate the path of the travelling sheets S, S' of the rewinder with slitter over the operator. Further, if sufficient fricitional force is produced between the unwinding rollers 8 and the sheet S, there is no need to clamp the opposite sides of the sheet S by a pair of unwinding rollers 8, so that it is possible to employ an unclamping-type single unwinding roller 8 or such type of plurality of unwinding rollers.

As is clear from the above description, according to the present invention, a touch roller 1 provided with its own driving means is provided in each of the winding axles C on which the slit sheets S' are wound, so that it is possible to wind the slit sheet S' into a high quality sheet roll R at a high speed, whereby the productibility of the rewinder with slitter is remarkably increased.

What is claimed is:

1. A rewinder with a slitter in which a striplike sheet is unwound by an unwinding roller and slit into a plurality of slit sheets which are distributed to winding axles rotated at first and second winding positions along a base mount extending in the width direction of the unwound sheet, said winding axles are driven for rewinding by drive means capable of torque adjustment in contact with touch rollers which are driven with the torque of a motor driving said unwinding roller transmitted through a finely adjustable speed change mechanism, comprising:

a pair of support frames provided for each predetermined slit sheet winding position and having one end slidably engaged with said base mount and the other end provided with support means for detachably supporting a touch roller;

touch rollers each supported by said support means of said support frames and in contact with the outer periphery of a sheet roll being formed on the winding axle;

a screw shaft extending along said base mount and penetrating said support frames for driving said touch roller;

torque transmitting means provided on one of said support frames and having one end connected to said screw shaft and the other end connected to said touch roller;

a driving axle extending along said base mount and penetrating said support frames for moving said support frames in the width direction of the sheet;

a female screw rotatably penetrating and supported in said support frame and screwed on said driving axle; and engaging means provided on said support frame and engaging with said female screw.

2. The rewinder with a slitter according to Claim 1 wherein said screw shaft for driving said touch rollers is provided at each of said first and second winding positions.

3. The rewinder with a slitter according to claim 1, wherein said screw shaft is provided on said base mount for driving said touch rollers at said first and second winding positions.

4. The rewinder with a slitter according to claim 1, wherein said engaging means engaging with said female screw provided in said support frame is an oil hydraulic cylinder for urging the outer periphery of said female screw with a frictional member.

5. The rewinder with a slitter according to claim 1, wherein said support frame includes a detecting roller for detecting the tension in a slit sheet before being wound.

6. The rewinder with a slitter according to claim 1, wherein said support frame has a supporting base engaged with said base mount and a support arm provided with means for supporting a touch roller.

7. The rewinder with a slitter according to claim 1, wherein said finely adjustable speed change mechanism is provided in torque transmitting means between said motor and said screw shaft.

8. The rewinder with a slit according to claim 1, wherein said finely adjustable speed change mechanism is provided in torque transmitting means provided in a support frame.

9. A rewinder with a slitter in which a striplike sheet is unwound by an unwinding roller and slit into a plurality of slit sheets which are distributed to respective winding positions arranged vertically in two rows, each slit sheet being thereby wound on a winding axle held at a predetermined position with the opposite ends supported in outer frames and centrally driven, comprising:

a plurality of touch rollers provided at each said split sheet winding position and extending parallel to said winding axle to be in contact sidewise with the outer periphery of a sheet roll being formed on said winding axle;

a pair of upper and lower, base mounts provided between a pair of left and right inner frames movable horizontally in a direction perpendicular to the axis of said winding axle, said base mounts extending along said touch rollers;

a pair of support frames for removably supporting said touch roller and each comprising a support base slidably engaged with the base mount and a support arm having one end thereof connected to the base mount and the other end thereof adapted to support said touch roller;

a hydraulic cylinder provided between said support base and support arm and capable of adjustment of the urging force of the touch roller against the sheet roll;

a drive mechanism for driving said inner frames toward said winding axle;

drive means for detecting the growth of a sheet roll and instructing driving to said drive mechanism such as to maintain a substantially constant rotational angle of said support arm with the growth of the sheet roll being formed;

a drive axle extending along the base mounts for driving said touch rollers, and penetrating the support base and support arm of said support frame for allowing the support base and support arm to be rotated thereabout and moved in the width direction of the strip-like sheet;

torque transmitting means mounted on said touch rollers for transmitting the torque of said drive axle to said touch rollers;

a motor for driving said drive axle and unwinding roller; and a speed change mechanism provided between said touch roller and said motor and capable of speed ratio adjustment.

* * * * *